US006200949B1

(12) United States Patent
Reijmer et al.

(10) Patent No.: US 6,200,949 B1
(45) Date of Patent: Mar. 13, 2001

(54) PROCESS FOR FORMING SOLID PHASE CONTROLLABLY RELEASABLE FRAGRANCE-CONTAINING CONSUMABLE ARTICLES

(75) Inventors: Henricus Gerardus Maria Reijmer, Hoevelaken (NL); Adi Shefer, East Brunswick, NJ (US)

(73) Assignee: International Flavors and Fragrances Inc., New York, NY (US)

( * ) Notice: Subject to any disclaimer, the term of this patent is extended or adjusted under 35 U.S.C. 154(b) by 0 days.

(21) Appl. No.: 09/468,850

(22) Filed: Dec. 21, 1999

(51) Int. Cl.[7] ..... C11D 11/02

(52) U.S. Cl. ..... 510/443; 510/334; 510/394; 510/444; 510/452; 510/470; 510/474

(58) Field of Search ..... 510/443, 452, 510/444, 394, 334, 474, 470; 424/401

(56) References Cited

U.S. PATENT DOCUMENTS

| | | | | |
|---|---|---|---|---|
| 4,568,560 | * | 2/1986 | Schobel | 427/3 |
| 4,576,737 | * | 3/1986 | Johnson | 510/101 |
| 4,689,235 | * | 8/1987 | Barnes et al. | 426/89 |
| 5,009,900 | * | 4/1991 | Levine et al. | 426/96 |
| 5,124,162 | * | 6/1992 | Boskovic et al. | 426/96 |
| 5,246,603 | * | 9/1993 | Tsaur | 510/519 |
| 5,603,971 | * | 2/1997 | Porzio et al. | 426/96 |
| 5,648,328 | * | 7/1997 | Angell et al. | 510/441 |
| 5,783,211 | * | 7/1998 | Manzo et al. | 424/450 |
| 5,876,755 | * | 3/1999 | Perring et al. | 424/489 |
| 5,897,897 | * | 4/1999 | Porzio et al. | 426/96 |
| 5,935,826 | * | 8/1999 | Blue et al. | 435/96 |
| 6,045,823 | * | 4/2000 | Vollhardt et al. | 424/450 |
| 6,056,949 | * | 5/2000 | Menzi et al. | 424/76.1 |
| 6,083,529 | * | 7/2000 | Manzo et al. | 424/450 |

OTHER PUBLICATIONS

National Starch & Chemical Division of the Imperial Chemical Industry Group brochure entitled "*Narlex PPE1388/High performance encapsulation Starch*" published in 1995.

* cited by examiner

*Primary Examiner*—Lorna M. Douyon
(74) *Attorney, Agent, or Firm*—Arthur L. Liberman

(57) ABSTRACT

Described is a process for forming controllably releasable fragrance-containing consumable articles, for example, encapsulated fragrances in detergents or fabric softener articles and compositions. The process includes the steps of:

(a) forming an aqueous fragrance emulsion, including a modified starch;

(b) spray drying or freeze drying the emulsion to form a fragrance-containing powder; and (c) mixing a solid consumable article base (e.g., detergent or fabric softener base) with the fragrance-containing powder.

Also described are products produced by means of such processes as well as uses thereof.

3 Claims, No Drawings

PROCESS FOR FORMING SOLID PHASE CONTROLLABLY RELEASABLE FRAGRANCE-CONTAINING CONSUMABLE ARTICLES

BACKGROUND OF THE INVENTION

Our invention relates to compositions suitable as long lasting fragranced consumable articles, including but not limited to underarm deodorant compositions, antiperspirant sticks, detergents, fabric softener compositions and fabric softener articles.

It is well known in the art to produce fragrance compositions for detergents and for deodorants and antiperspirants. In the case of deodorants and antiperspirants, it is well known to produce such materials wherein a fragrance is released from the composition after application of the composition to the skin, that is body-activated fragrances. In this case, it is desired that such products produce a low level of odor prior to application to the skin, but which release fragrances at a steady raised level after application to the skin.

It is also known in the art to control human body odors by the use of deodorant products, particularly in the underarm area of the body. Deodorant products generally contain a perfume or other odor-masking ingredients in a vehicle from which active ingredients may be deposited on the skin. The deodorant products may be in the form of solid or semisolid sticks.

It is also known in the art to mask "detergent" type aromas in consumable articles, including detergents, fabric softener compositions and fabric softener articles.

Thus, particular needs exist for (i) a deodorant or antiperspirant composition having a pleasant fragrance which lasts for a long time; and (ii) fabric softener compositions, detergents and fabric softener articles having a pleasant fragrance which lasts for a long time.

It is known to delay release of a fragrance from consumable materials, such as detergents, fabric softeners, fabric softener articles and deodorant sticks, by methods such as micro encapsulation of the fragrance substance. However, delayed fragrance release from such compositions and articles have not been effectively obtained using microencapsulation, principally because microencapsulating a fragrance in a water-containing base, such as a water-containing deodorant stick base, dissolves the protective microencapsulation encoding and prematurely releases the fragrance. Indeed, several attempts at attaining fragrance longevity for such products have been made in the art employing encapsulation and spray drying techniques. Prior methods have produced inconsistent results, either because they have involved a rupturing of microcapsule walls by mechanical pressure to achieve fragrance release or encapsulating polymers have generally presented incompatibility problems with the fragrance resulting in distortion of the fragrance profile.

The use of modified starches in the food flavor area for encapsulation of food flavors is taught by the *Technical Service Bulletin* for "HI-CAP™ 100," a product manufactured by National Starch and Chemical Company, Food Products Division, 10 Finderne Avenue, Bridgewater, N.J. 08807-0500. In the *Technical Service Bulletin* for HI-CAP™ 100, it is indicated:

"Spray-dried flavors prepared with HI-CAP™ 100 can be used in a variety of finished food products. These include dry beverage mixes reconstituted by the addition of water . . . "

Furthermore, the *Technical Service Bulletin* for HI-CAP™ 100 indicates a procedure for encapsulation, to wit;

"1. Disperse HI-CAP[™] 100 in water with good agitation.
2. Heat the dispersion to 180° F. (82° C.)[.]
3. Cool the suspension to the desired temperature. If a cloud emulsion is to be prepared, the starch suspension should be kept at a higher temperature than the melting point of the fat.
4. Add the flavor oil or melted fat with agitation to form the pre-emulsion.
5. Emulsify to a particle size of 1- to 2-microns using the appropriate equipment (Colloid mill, homogenizer, blender, etc.)[.]
6. Spray dy the emulsion."

In a bulletin for another modified starch, NARLEX® PPE1388, *National Starch & Chemical* indicates that "At high oil loads, 100% NARLEX® PPE1388 and 0% maltodextrin is recommended." In another section of the brochure on NARLEX® PPE1388 (a modified hydrophobic starch, that is starch sodium octenyl succinate), National Starch & Chemical Company indicates:

"Encapsulates 40% oil with:
Retention equal to 20% loading
Oxidation resistance equal to 20% loading
Surface oil equal to 20% loading
Can be spray dried at high solid concentrations of ~40% vs. 20–35% for traditional systems based on OSA/maltodextrine blends, gum arabic etc. . . . "

The novel compositions of our invention and the novel processes are not disclosed in such brochures. Thus, nothing in the prior art states the advantage of encapsulating hydrophilic fragrances in a combination of maltodextrin and hydrophobic modified starch.

U.S. Pat. No. 5,614,179 (incorporated by reference herein) teaches deodorant products containing a polymer/fragrance encapsulated bicarbonate ingredient. A deodorant or antiperspirant-deodorant cosmetic stick comprises an organic matrix having a dispersed particle phase of an encapsulated bicarbonate salt such as sodium bicarbonate. The particle surfaces are coated with a film forming medium comprising a blend of a polymer and a fragrance. When this product is applied to underarm surfaces, the deodorizing activity is signaled by the release of a fragrance aroma.

U.S. Pat. No. 4,731,243 (incorporated by reference herein) teaches deodorant and/or antiperspirant sticks which contain suspended therein fragrance containing polymeric pellets containing 1 to 80% fragrance. The polymeric pellets are produced by means of cryogenically grinding an extruded mixture of perfume composition and polymer. U.S. Pat. No. 4,428,869, which is also incorporated by reference herein, teaches a microcapsule suspension of a fragrance which yields a continuously high fragrance intensity release evenly and uniformly over an extended period of time.

None of these prior disclosures achieve a fragrance release effect for detergents and other consumable articles in the manner that the instant invention does.

Thus, it is still desired to provide consumable articles, e.g., deodorant or antiperspirant compositions, detergents, fabric softener compositions or fabric softener articles having a delayed release of fragrance over a long period of time without decomposition of the fragrance. It is particularly desired to provide such a product wherein the fragrance is released after contact of the composition with skin moisture.

None of the foregoing prior art teaches the use of the starch esters employed by the present invention in combination with maltodextins to encapsulate a fragrance whereby the resulting fragrance is released evenly and intensively over a long period of time.

THE INVENTION

Our invention relates to a process for forming controllably releasable fragrance-containing consumable articles, including but not limited to solid detergent compositions containing encapsulated fragrances; solid fabric softener compositions containing encapsulated fragrances; fabric softener articles containing encapsulated fragrances in the interstices thereof; deodorant sticks containing encapsulated fragrances; and antiperspirant sticks containing encapsulated fragrances.

The process for forming the encapsulated fragrances includes the steps of:

(a) forming an aqueous fragrance emulsion, which includes a modified starch as well as a maltodextrin and the fragrance;

(b) spray drying or freeze drying the resultant emulsion to form a fragrance-containing powder; and (c) mixing a solid consumable article base (for example, a detergent base, a fabric softener base, a deodorant stick base or an antiperspirant stick base) with the fragrance-containing powder.

Our invention is also related to products produced by means of such process as well as uses thereof.

More specifically, our invention is directed to a process for forming a solid phase controllably releasable fragrance-containing consumable material comprising the steps of:

(i) admixing by means of homogenization water, a maltodextrin, a hydrophobic modified starch and at least one hydrophilic fragrance ingredient in order to form an aqueous fragrance emulsion containing:
40–60% water;
3–30% maltodextrin;
10–40% hydrophobic modified starch; and
7–30% hydrophilic fragrance;

(ii) spray drying or freeze drying the resulting aqueous fragrance emulsion whereby solid phase fragrance-occluded-carbohydrate particles are formed having a particle size of from about 3 up to about 10 microns and a fragrance content of from about 15 up to about 50% by weight are formed;

(iii) providing a consumable material base; and (iv) blending the solid phase fragrance-occluded-carbohydrate particles with said consumable product base, thereby forming the solid phase controllably releasable fragrance-containing consumable article.

The consumable article, in addition to the detergent, deodorant stick, antiperspirant stick, fabric softener or dryer-added fabric softener article, may also include candle wax bases.

The hydrophobic modified starch may be a starch alkali metal $C_5$–$C_{12}$ alkenyl succinate substituted starch, preferably starch sodium 6octenyl succinate, marketed under the tradename HI-CAP™ 100 or under the tradename NARLEX® PPE1388 (trademarks of the National Starch & Chemical Division of Imperial Chemical Industries, Inc. of Bridgewater, N.J.).

Although the preferred embodiment of our invention is directed to the starch 6-octenyl succinate, our invention can be carried out using any starch ester having a degree of substitution of from about 1.2 up to about 2.2 of one or more α-($C_5$–$C_{15}$ straight-chain alkenyl) ($C_3$–$C_7$ dicarboxylic acids).

A specific example of the process of our invention is a process for forming solid phase particulate controllably releasable fragrance-containing detergent-fabric softening compositions comprising the steps of:

(i) admixing by means of homogenization water, a maltodextrin, a hydrophobic modified starch (as exemplified, supra) and at least one hydrophilic fragrance ingredient to form an aqueous fragrance emulsion containing:
40–60% water;
3–30% maltodextrin;
10–40% hydrophobic modified starch (as defined, supra); and
7–30% hydrophilic fragrance;

(ii) spray drying or freeze drying the resulting aqueous fragrance emulsion whereby solid phase fragrance-occluded-carbohydrate particles are formed having a particle size of from about 3 up to about 10 microns and a fragrance content of from about 15 up to about 50% by weight are formed;

(iii) admixing a solid powdered detergent with a solid phase clay softener to form a solid phase powdered detergent-softener composition; and (iv) blending the solid phase fragrance-occluded-carbohydrate particles with the powdered detergent-softener composition, thereby forming the solid phase particulate controllably releasable fragrance-containing detergent-fabric softening composition.

An example of the maltodextrin useful in the practice of our invention is GRANADEX® M20, a maltodextrin obtained by enzymatic conversion of potato starch having a particle size of between 80 and 200 microns and a dextrose equivalent of between about 17 up to about 20 grams per 100 grams of product. GRANADEX® M20 is a trademark of the AVEBE Corporation.

In the aforementioned process, the initially formed aqueous fragrance emulsion is prepared by means of homogenization. Suitable equipment for the homogenization of the mixture of water, maltodextin, the hydrophobic modified starch and the hydrophilic fragrance ingredient may include a Model 15 MR Laboratory Homogenizer, available from the APV Gaulin, Inc. of Everett, Mass., a rotar-stator high shear mixer, available from Silverson Machines of East Long Meadow, Massachusetts or Scott Process Equipment of Sparta, N.J.

The step of spray drying or freeze drying is well known in the art. The step of spray drying is exemplified by U.S. Pat. Nos. 5,525,367 and 5,417,153, which are incorporated herein by reference. Spray drying can be carried out, for example, in a Bowen Laboratory Model Spray Dryer or in an industrial spray dryer. The range of inlet temperatures for the spray drying step is from about 150° C. up to about 210° C., and the range of outlet temperatures for the spray drying is from about 80° C. up to about 100° C.

The resultant spray dried product is then admixed with a consumable material, to wit:

(a) a detergent powder;

(b) a fabric softening powder;

(c) the composition for production of dryer added fabric softeners;

(e) a deodorant stick composition; or (f) an antiperspirant stick composition.

The blending may be carried out in any suitable fashion with a variety of mixers known in the art, such as paddle or ribbon mixers. Although other mixers, such as ribbon or plow blenders, drum agglomerators, fluidized beds, pan agglomerators and high shear mixers may be used in this step also.

With reference to the use of fragrances, any fragrance suitable for application to the skin can be used herein, including a wide variety of hydrophilic fragrances and perfumes that are known to those skilled in the art. The particular fragrance used is largely a matter of choice; however, the fragrance should be used at a level effective for providing a noticeable aroma to the composition or for masking an undesired malodor. Also, the fragrance and whatever carriers accompany it should not impart excessive stinking to the skin (even when used in conjunction with detergents or fabric softeners), especially broken or irritated skin. The fragrance is preferably totally water-soluble, but at least hydrophilic.

Fragrance formulations are produced by those skilled in the art in a wide variety of ingredients and strengths. Typical fragrances are described in Arctander, *Perfume and Flavor Chemicals* (*Aroma Chemicals*), Volumes I and II (1969) and Arctander, *Perfume and Flavor Materials of Natural Origin* (1960), both incorporated by reference herein. Among the fragrance components useful in the practice of our invention are alcohols such as dimyrcetol, phenylethyl alcohol and tetrahydromuguol; aldehydes such as decyl aldehyde, undecylaldehyde, undecylenic aldehyde, lauric aldehyde, amyl cinnamic aldehyde, methyl nonyl acetaldehyde, myristic aldehyde, nonyl aldehyde, octyl aldehyde and hexyl cinnamic aldehyde. A useful hydroxyaldehyde is LYRAL® (trademark of International Flavors & Fragrances Inc.), which is hydroxy-t-amyl-cyclohexene carboxaldehyde.

When incorporating the solid phase france-occluded carbohydrate particles with the consumable material of our invention, e.g., deodorant stick composition or antiperspirant stick composition, the base composition thereof may comprise any composition known in the art for use in a deodorant or antiperspirant composition and which is capable of suspending the encapsulated fragrance therein. Such a base composition comprises at least one suspension agent in an amount sufficient to suspend the solid phase fragrance-occluded carbohydrate particles. A preferred suspension agent comprises sodium stearate, a hydrocarbon wax or a mixture thereof. The deodorant stick compostition or antiperspirant stick composition may also include deodorant-active or antiperspirant-active ingredients, soap gelling agents, polyhydroxy solvents and other optional ingredients.

Suitable deodorant-active ingredients include antimicrobial such as bactericides and fungicides. Exemplary deodorant-active ingredients include quaternary ammonium compounds such as cetyl-trimethyl ammonium bromide, cetyl-pyridinium chloride, N-myristoyl glycine and farnesol (which also adds fragrance nuances). Mixtures of deodorant-active ingredients are also contemplated and intended to be encompassed herein. The deodorant-active ingredient may comprise from about 0.001% up to about 50% by weight, preferably from about 0.01% up to about 20% by weight of the antiperspirant or deodorant composition. For purposes herein, a deodorant-active ingredient is defined as an ingredient which prevents or eliminates malodors from perspiration, as opposed to a france which covers or masks odor.

The deodorant or antiperspirant composition used herein preferably incorporates a soap gelling agent. Soap gelling agents include salts of fatly acids containing from about 12 up to about 40 carbon atoms, preferably salts of $C_{12}$–$C_{22}$ fatty acids. Suitable salt forming cations for use in these gelling agents include metal salts such as alkali metals, e.g., sodium and potassium; and alkine earth metals, e.g., magnesium and calcium. Preferred are sodium and potassium salts. Examples of fatty acids useful in synthesizing the gel forming agents herein include myristic, palmitic, stearic, oleic and linoleic acids and mixtures of same. Naturally occurring sources of such fatty acids include coconut oil and olive oil. Preferred fatty acid soap-type gel forming agents include sodium stearate, sodium palmitate, potassium stearate, potassium palmitate, sodium myristate and aluminum monostearate. The most preferred gel forming agent is sodium stearate. Soap gelling agents may be used in an amount of from about 0.1% up to about 15% by weight, preferably from about 1% up to about 5% based on the weight of the antiperspirant or deodorant composition.

Furthermore, the composition may comprise a polyhydroxy solvent. Suitable polyhydroxy solvents may comprise $C_3$–$C_{12}$ alcohols having at least three hydroxy groups, polyoxyethylene polymers, polyoxypropylene polymers and the like. Preferably such polymers have an average molecular weight of from about 200 up to about 4,000.

Detergent bases and fabric softener bases are those well known to those having ordinary sill in the art. Preferably when using a detergent base, a detergent base is combined with a softening agent. Examples of such softening agents are clay-type softening agents, for example, bentonite clay.

This invention can be further illustrated by the following examples of preferred embodiments thereof, although it will be understood that these examples are included merely for purposes of illustration and are not intended to limit the scope of the invention, unless otherwise specifically indicated.

EXAMPLE I

PREPARATION OF FRAGRANCE

The following ingredients are admixed to formulate a floral/citrus hydrophilic fragrance:

| Ingredients | Parts by Weight |
|---|---|
| citronellol | 20 |
| LYRAL ® | 20 |
| hexylcinnamic aldehyde | 14 |
| ROSALVA ® (1-hydroxy-9-decene) | 15 |
| geraniol | 10 |
| nerol | 12 |
| β-phenylethyl alcohol | 14 |
| geranial | 18 |
| tetrahydromuguol | 14 |

The resulting fragrance has a rose, muguet aroma with lilac topnotes.

EXAMPLE II

20 Grams of the fragrance composition of Example I is emulsified in a solution containing 100 grams of water, 50 grams of maltodextrin MD 01318 and 25 grams of HI-CAP™ 100 modified starch.

The resulting emulsion is spray dried with a Bowen Lab Model dryer utilizing 250 cubic feet per minute of air with an inlet temperature of 400° F. and an outlet temperature of 200° F. and a wheel speed of 50,000 rpm.

EXAMPLE III

20 Grams of the fragrance composition of Example I is emulsified in a solution containing 50 grams of water, 6.0 grams of maltodextrin MD 01318 and 24 grams of NARLEX® PPE1388. The resulting emulsion is quickly chilled using a liquid quenching medium (water at 3° C.) and evaporated under 2 mm/Hg pressure for a period of 20 minutes. The resulting freeze dried material contains fragrance and is cryogenically ground using liquid nitrogen to achieve a particle size of 7 microns (average).

EXAMPLE IV

A wax-type deodorant stick composition having the following formulation is prepared by blending:

| Ingredients | Parts by Weight |
|---|---|
| ARISTOWAX ® 165 (registered trademark of Witco Chemical Corporation for a paraffin wax) | 14.0 |
| ozokerite wax 170-D (hydrocarbon wax) | 8.0 |
| white petrolatum | 13.0 |
| ACETULAN ® (acetylated lanolin oil manufactured by Amerchol Chemical Company) | 2.8 |
| di-isopropyl adipate | 6.0 |
| mineral oil | 52.1 |
| propyl paraben | 0.1 |

The resulting composition is heated to 75° C. until melted. With stirring, 4.0 parts by weight of the solid phase fragrance-occluded carbohydrate particles prepared according to Example II are added to the wax deodorant stick formulation while maintaining the temperature at 75–80° C. The resulting mixture is stirred in order to ensure a uniform suspension of the solid phase fragrance-occluded carbohydrate particles in the deodorant stick formulation. The resulting suspension is then poured into stick molds, thereby formulating deodorant sticks containing solid phase fragrance-occluded carbohydrate particles (encapsulated fragrance) suspended therein, each stick being cylindrical and having a length of 3 inches and a diameter of 1 inch. The resulting product after application creates a fragrance on the wearer at an intensity level of "8" (on a scale 1–10) for a period of 12 hours.

EXAMPLE V

PREPARATION OF ANTIPERSPIRANT/ DEODORANT

The following composition is prepared:

| Ingredients | Parts by Weight |
|---|---|
| propylene glycol | 65.00 |
| sodium stearate | 7.00 |
| distilled water | 23.75 |
| IRGASAN ® DP-300 (2,4,4-trichloro-2'-hydroxydiphenyl ether manufactured by the Ciba-Geigy Chemical Company and a trademark of the Ciba-Geigy Chemical Co.) | 0.25 |

The ingredients are combined and heated to 75° C. with stirring. The ingredients are mixed and continued to be heated until the sodium stearate is dissolved. 10 Grams of the solid phase fragrance-occluded carbohydrate particles produced according to Example III are then slowly added to the resulting molten mixture. The resulting product is then cooled to 45° C. and poured into stick molds, and the stick molds are cooled to 15° C. The molds are then removed from the resulting deodorant/antiperspirant sticks, which are cylindrical, 3 inches in length and 1 inch in diameter. The resulting deodorant/antiperspirant sticks impart a rose/muguet aroma with lilac topnotes to the wearer at an intensity level of "8" (on a scale of 1–10) for a period of 12 hours.

EXAMPLE VI

15 Grams of a TIDE® (registered trademark of the Procter & Gamble Company of Cincinnati, Ohio) powdered detergent base is intimately admixed with 5 grams of the solid phase fragrance-occluded carbohydrate particles produced according to Example III. On use of the resulting detergent in a standard washing machine cycle followed by a standard hot air drying cycle, the resulting dried clothes emit a pleasant aesthetically pleasing rose/muguet aroma with lilac topnotes for a period of 12 hours.

EXAMPLE VII

100 Grams of TIDE® detergent is admixed with 10 grams of bentonite clay softener and 5 grams of the solid phase fragrance-occluded carbohydrate particles prepared according to Example II. The resulting product is utilized on clothing in a standard washing cycle followed by a standard drying cycle. The resulting clothing emits an aesthetically pleasing rose/muguet aroma with lilac topnotes for a period of 12 hours subsequent to removal from the clothes dryer.

What is claimed is:

1. A process for forming a solid phase particulate controllably releasable fragrance-containing detergent-fabric softening composition consisting of the sequential steps of:

(i) initially admixing by means of homogenization water, a maltodextrin, a hydrophobic modified starch and at least one hydrophilic fragrance ingredient in order to form an aqueous fragrance emulsion containing:
40–60% by weight water;
3–30% by weight maltodextrin;
10–40% by weight hydrophobic modified starch; and
7–30% by weight hydrophilic fragrance;

(ii) spray drying or freeze drying the resulting aqueous fragrance emulsion whereby solid phase fragrance-occluded carbohydrate particles are formed having a particle size of from about 3 up to about 10 microns and a fragrance content of from 15–50% by weight are formed;

(iii) admixing a solid powdered detergent with a solid phase clay softener to form a solid phase powdered detergent-softener composition; and (iv) blending the solid phase fragrance-occluded carbohydrate particles with the powdered detergent-softener composition, thereby forming the solid phase particulate controllably releasable fragrance-containing detergent-fabric softening composition.

2. The process of claim 1 wherein in step (i), the hydrophobic modified starch is a starch alkali metal $C_5$–$C_{12}$ alkenyl succinate.

3. The process of claim 2 wherein the hydrophobic modified starch is a starch sodium octenyl succinate.

* * * * *